US007234654B2

(12) United States Patent
Holzgrefe et al.

(10) Patent No.: US 7,234,654 B2
(45) Date of Patent: Jun. 26, 2007

(54) FUEL INJECTOR

(75) Inventors: Volker Holzgrefe, Ditzingen (DE); Stefan Arndt, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/559,550

(22) PCT Filed: Apr. 7, 2004

(86) PCT No.: PCT/DE2004/000727

§ 371 (c)(1),
(2), (4) Date: Apr. 12, 2006

(87) PCT Pub. No.: WO2004/109094

PCT Pub. Date: Dec. 16, 2004

(65) Prior Publication Data

US 2006/0226263 A1 Oct. 12, 2006

(30) Foreign Application Priority Data

Jun. 4, 2003 (DE) ..... 103 25 289

(51) Int. Cl.
*F02M 61/00* (2006.01)

(52) U.S. Cl. ..... 239/533.12; 239/585.1; 239/533.2; 239/499; 239/500; 239/900; 239/533.11; 239/88; 239/585.5

(58) Field of Classification Search ..... 239/533.12, 239/533.2, 585.1, 585.4, 585.5, 533.11, 499, 239/500, 518, 524, 88, 900
See application file for complete search history.

(56) References Cited

U.S. PATENT DOCUMENTS 4,077,374 A * 3/1978 Willmann et al. ..... 123/536
5,381,965 A * 1/1995 Chabon et al. ..... 239/585.1
5,692,723 A * 12/1997 Baxter et al. ..... 251/129.21
5,694,898 A * 12/1997 Pontoppidan et al. ..... 123/470
6,334,580 B2 * 1/2002 Cohen ..... 239/585.4
2003/0015609 A1 1/2003 Kobayashi et al.
2003/0164412 A1 9/2003 Iwase

FOREIGN PATENT DOCUMENTS

| | | |
|---|---|---|
| DE | 40 36 294 | 5/1991 |
| DE | 41 00 457 | 7/1991 |
| DE | 195 03 224 | 8/1996 |
| DE | 100 21 073 | 2/2001 |
| DE | 199 37 961 | 2/2001 |
| DE | 102 03 622 | 10/2002 |
| DE | 102 31 443 | 1/2003 |
| EP | 0 116 864 | 8/1984 |
| FR | 733 591 | 10/1932 |
| FR | 2 773 852 | 7/1999 |
| GB | 185 640 | 9/1922 |
| GB | 258 431 | 9/1926 |
| JP | 06-101598 | 4/1994 |

* cited by examiner

*Primary Examiner*—Dinh Nguyen
(74) *Attorney, Agent, or Firm*—Kenyon and Kenyon LLP

(57) ABSTRACT

A fuel injector, in particular for the direct injection of fuel into a combustion chamber of an internal combustion engine, having a valve-closure member which cooperates with a valve-seat surface formed on a valve-seat body, to form a sealing seat, includes at least one spray-discharge orifice provided downstream from the sealing seat. The spray-discharge orifice has a guide region and an exit region arranged at its discharge-side end. The exit region widens in a stepped manner by at least one first step and/or at least in part continuously beginning with a transition from the guide region into the exit region. A fuel jet which emerges from the guide region at the transition and widens essentially uniformly at a jet angle, passes a discharge-side end of the exit region with a gap dimension of a gap after a distance s, the gap dimension being greater than zero and a first volume remaining in the exit region between the fuel jet and the inner walls of the exit region.

8 Claims, 2 Drawing Sheets

FUEL INJECTOR

FIELD OF THE INVENTION

The present invention relates to a fuel injector.

BACKGROUND INFORMATION

A fuel injector having a stepped spray-discharge orifice is described in German Patent Application No. DE 199 37 961 A1, for example. The spray-discharge orifice is divided into a through hole and a discharge-side or flow-off-side exit region, the exit region differing from the through hole in form, contour and size.

A particular disadvantage of the fuel injector described in the aforementioned printed publication is that, given a correspondingly broadened fuel jet emerging from the through hole, parts of the exit region may be directly exposed to the action of the fuel. In addition, in an exit region whose contour and size is similar to that of the fuel jet, no other volume remains in the exit region. As a result of both disadvantages, fuel remains in the vicinity of the discharge orifice after the spray-discharge operation since hardly any gas turbulence, which removes fuel from the region of the spray-discharge orifice once the injection process has been completed, is able to form. This can cause combustion deposits to form after a short operating time, which have a disadvantageous effect on the further operation of the fuel injector. In addition, the fuel residue that remains in the region of the spray-discharge orifice after the discharge operation increases the emission values and the fuel consumption.

Furthermore, it is impossible to fully adapt the length/width ratio and the fuel pressure to the various requirements of different internal combustion engines.

SUMMARY

An example fuel injector according to the present invention may have the advantage of effectively preventing fuel deposits in the region of the spray-discharge orifice.

Moreover, the length/width ratio of the spray-discharge orifice and the fuel pressure may be freely modified and selected while retaining the gap size. The adaptation of the injection behavior of the fuel injector to different internal combustion engines may thus be carried out in an especially simple manner. The atomization, emission values and fuel consumption are improved.

In accordance with an example embodiment of the present invention, a remaining first volume is advantageously calculated according to, e.g., $$B = \frac{|D \cdot \pi \cdot Ag|}{|d \cdot \pi \cdot s|},$$

and the gap dimension is not greater than 0.3 mm and not smaller than 0.1 mm since this ensures an optimally dimensioned first volume even in the case of different geometries of the spray-discharge orifice or the exit region. An optimal vortex formation in the first volume is guaranteed, and an aspiration effect between the inner walls of the exit region and the fuel jet is reliably prevented.

It is also advantageous if the guide region and the exit region are arranged coaxially with respect to one another.

This facilitates an especially uniform vortex formation in the first volume.

Since the transition from guide region to exit region widens in a conical manner in the spray-discharge direction, the fuel jet is able to be guided in an advantageous fashion. The geometry of the fuel jet is thereby able to be adapted to the geometry of the exit region.

Due to a cylindrical design of the exit region, the exit region is able to be produced in an especially simple manner.

If the guide region projects into the exit region and/or if the exit region at first widens continually counter to the spray-discharge direction, a vortex formation may be promoted as well.

BRIEF DESCRIPTION OF THE DRAWINGS

Exemplary embodiments of the present invention are shown in a simplified version in the figures and described in greater detail below.

DETAILED DESCRIPTION OF EXAMPLE EMBODIMENTS

Figure 1:
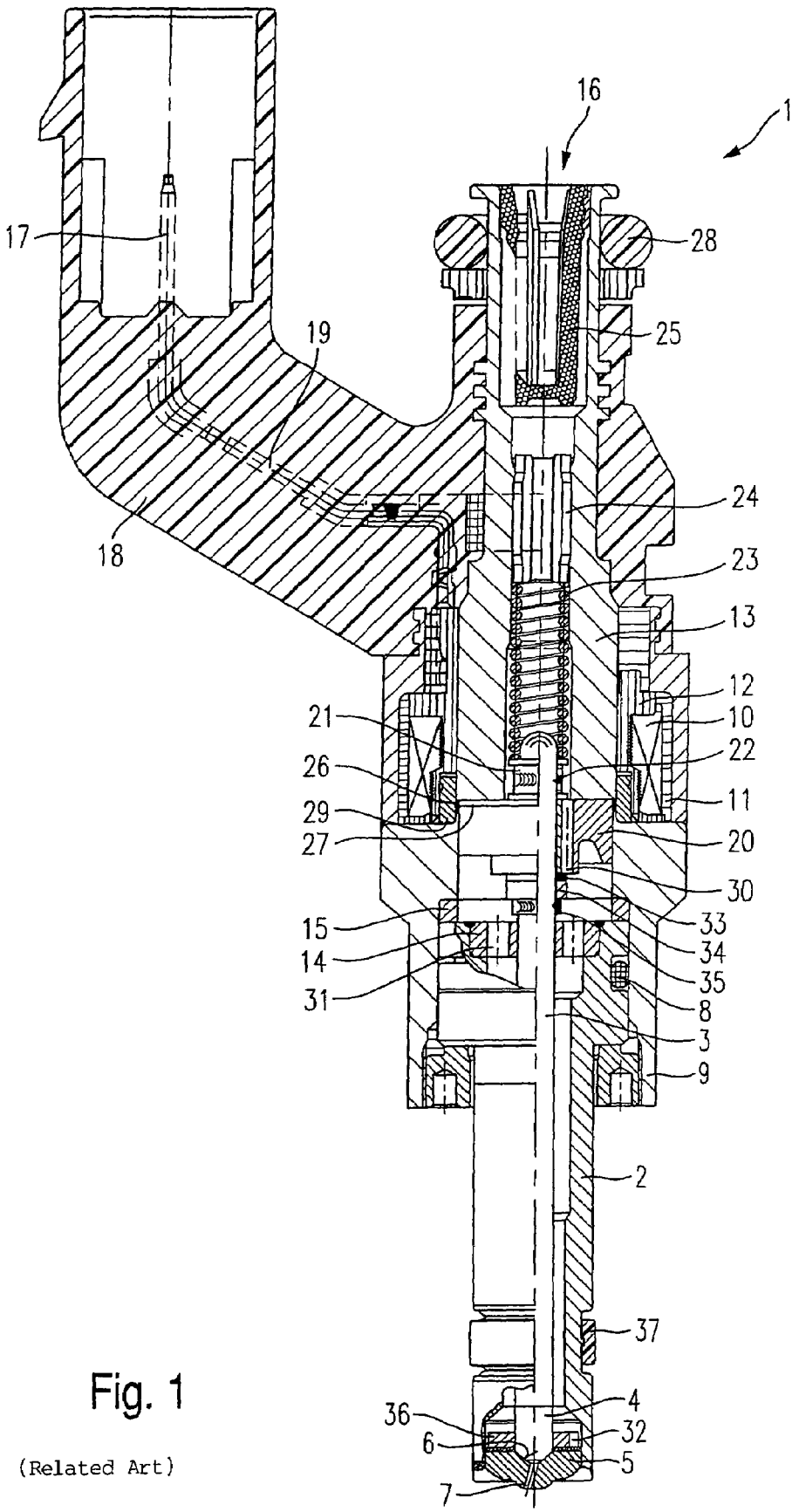
Fig. 1 (Related Art)
FIG. 1 shows a schematic section through an example of a conventional fuel injector.

In the following, exemplary embodiments of the present invention are described by way of example. Identical parts are provided with matching reference numerals in all of the figures. However, before preferred exemplary embodiments of the present invention are elucidated in greater detail with the aid of FIGS. 2 and 3, for a better understanding of the present invention, a fuel injector 1 is briefly explained in its basic components on the basis of FIG. 1.

A first exemplary embodiment of a fuel injector 1 according to the present invention, shown in FIG. 1, is designed in the form of a fuel injector for fuel-injection systems of mixture-compressing internal combustion engines having externally supplied ignition. Fuel injector 1 is particularly suited for the direct injection of fuel into a combustion chamber (not shown) of an internal combustion engine.

Fuel injector 1 is made up of a nozzle body 2 in which a valve needle 3 is positioned. Valve needle 3 is in operative connection with a valve-closure member 4, which cooperates with a valve-seat surface 6 positioned on a valve-seat body 5 to form a sealing seat. In the exemplary embodiment, fuel injector 1 is an inwardly opening fuel injector 1, which has one spray-discharge orifice 7 which is produced by simple drilling, for instance. Seal 8 seals nozzle body 2 from an outer pole 9 of a solenoid coil 10. Solenoid coil 10 is encapsulated in a coil housing 11 and wound on a coil brace 12, which rests against an inner pole 13 of solenoid coil 10. Inner pole 13 and outer pole 9 are separated from one another by a constriction 26 and interconnected by a non-ferromagnetic connecting part 29. Solenoid coil 10 is energized via a line 19 by an electric current, which may be supplied via an electrical plug contact 17. A plastic extrusion coat 18, which may be extruded onto inner pole 13, encloses plug contact 17.

Valve needle 3 is guided in a valve-needle guide 14, which is in the form of a disk. A paired adjustment disk 15 is used to adjust the (valve) lift. An armature 20 is positioned on the other side of adjustment disk 15. Via a first flange 21, it is connected to valve needle 3 by force-locking, and valve needle 3 is connected to first flange 21 by a welded seam 22. Braced on first flange 21 is a restoring spring 23, which is prestressed by a sleeve 24 in the present design of fuel injector 1.

Fuel channels 30, 31 and 32 run in valve-needle guide 14, armature 20 and along a guide element 36. The fuel is supplied via a central fuel supply 16 and filtered by a filter element 25. A seal 28 seals fuel injector 1 from a fuel distributor line (not shown further), and an additional seal 37 seals it from a cylinder head (not shown further).

On the spray-discharge side of armature 20 is an annular damping element 33 made of an elastomeric material. It rests on a second flange 34, which is integrally joined to valve needle 3 via a welded seam 35.

In the quiescent state of fuel injector 1, armature 20 is acted upon by restoring spring 23 against its direction of lift, in such a way that valve-closure member 4 is held in sealing contact on valve-seat surface 6. In response to excitation of solenoid coil 10, it generates a magnetic field that moves armature 20 in the lift direction, counter to the spring force of restoring spring 23, the lift being predefined by a working gap 27 that occurs in the rest position between inner pole 12 and armature 20. First flange 21, which is welded to valve needle 3, is taken along by armature 20, in the lift direction as well. Valve-closure member 4, which is connected to valve needle 3, lifts off from valve seat surface 6, so that the fuel is spray-discharged through spray-discharge orifice 7.

In response to interruption of the coil current, following sufficient decay of the magnetic field, armature 20 falls away from inner pole 13 due to the pressure of restoring spring 23, whereupon first flange 21, being connected to valve needle 3, moves in a direction counter to the lift. Valve needle 3 is thereby moved in the same direction, causing valve-closure member 4 to set down on valve seat surface 6 and fuel injector 1 to be closed.

Figure 2:
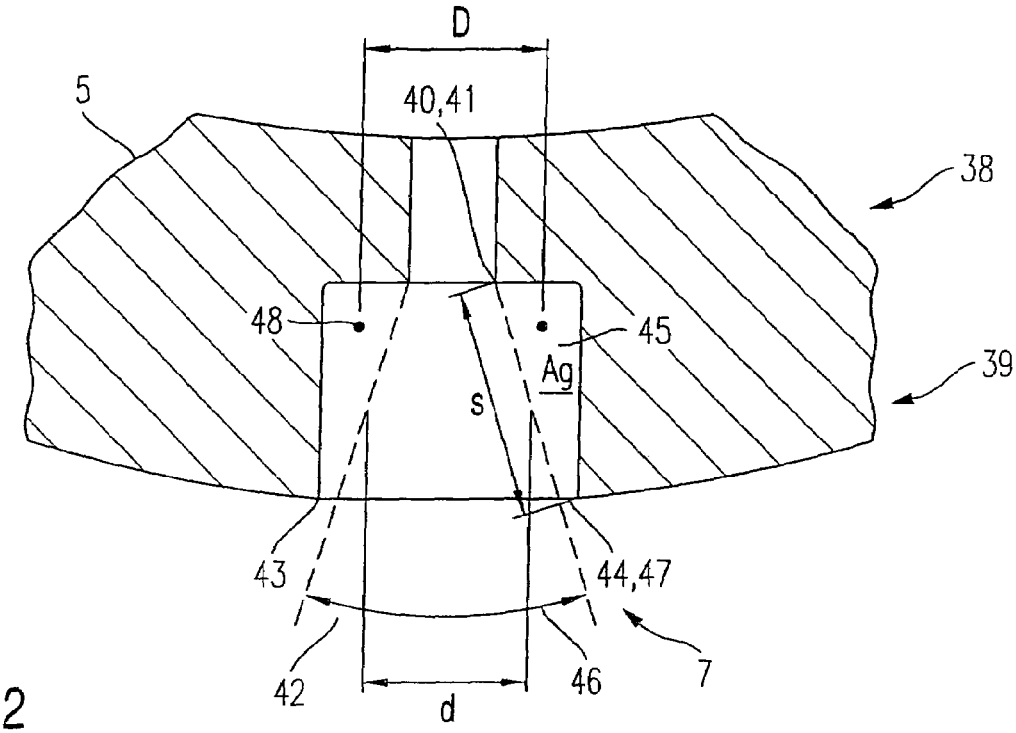
FIG. 2 shows a schematic section through a first exemplary embodiment of the fuel injector according to the present invention, in the region of the spray-discharge orifice.

FIG. 2 shows a schematic section through a first exemplary embodiment of fuel injector 1 according to the present invention, in the region of spray-discharge orifice 7. Spray-discharge orifice 7 is made up of a guide region 38 which is arranged on the inflow side, and an exit region 39 which is arranged on the spray-discharge side downstream from a transition 40 or a first step 41 thereto. Downstream from transition 40, rectangular step 41 widens guide region 38 into an exit region 39 extending in cylindrical form. In this exemplary embodiment, guide region 38 and exit region 39 are arranged coaxially with respect to one another.

In the exemplary embodiment, a fuel jet 42 emerging from guide region 38 into exit region 39 or into the combustion chamber (not shown) is indicated by dashed lines. Upon exiting from guide region 38 and beginning with transition 40, fuel jet 42 widens conically at a jet angle 46. In the exemplary embodiment, fuel jet 42 exits from guide region 38 coaxially. The outer boundaries of fuel jet 42 emerge from exit region 39 at a discharge-side end 43 of exit region 39 while maintaining a gap 44 having a gap dimension 47. Gap dimension 47 is greater than 0. Gap 44, having gap dimension 47, occurs at the shortest distance between fuel jet 42 and discharge-side end 43. Between transition 40 and gap 44, the outer boundary of fuel jet 42 covers a distance s.

A first volume between gap 44, the outer boundaries of fuel jet 42 and the inner walls of exit region 39, is not acted upon by fuel jet 42 during the injection procedure in exit region 39. The pressure is lowered in first volume 45 during the injection operation, which facilitates evaporation of the fuel. Gas vortexes are formed in volume 45, which contribute to the removal of fuel residue from spray-discharge orifice 7, in particular once the injection process has come to an end.

A longitudinal cross-sectional area Ag occurring in longitudinal section of first volume 45 has centers of mass 48 whose distance represents a first diameter D. The planar longitudinal section is implemented at a center axis (not shown) of exit region 39. A second diameter d likewise occurs in such a longitudinal section between two points, which are located at the outer boundaries of fuel jet 42 at the midpoint of distance s.

In the exemplary embodiment illustrated, the gap dimension is between 0.1 mm and 0.3 mm, preferably 0.2 mm.

To produce an optimal turbulence formation in the first volume, a coefficient B, which characterizes the first volume, amounts to at least 0.5, but maximally 2.5, preferably 1.5 in the illustrated exemplary embodiment.

Coefficient B is calculated according to the following formula:

$$B = \frac{|D \cdot \pi \cdot Ag|}{|d \cdot \pi \cdot s|}$$

All dimensioned variables are given in mm or $mm^2$.

Figure 3:
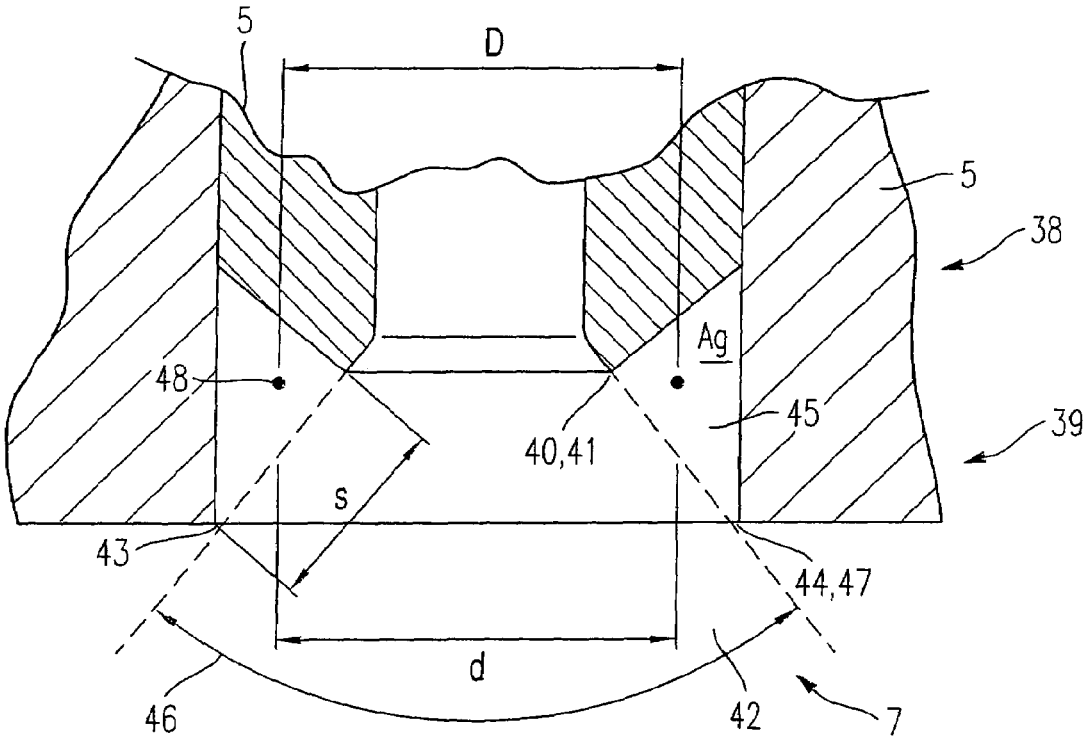
FIG. 3 shows a schematic section through a second exemplary embodiment of the fuel injector according to the present invention, in the region of the spray-discharge orifice.

FIG. 3 shows a schematic section through a second exemplary embodiment of fuel injector 1 according to the present invention, in the region of spray-discharge orifice 7. This fuel injector functions in the same manner as the first exemplary embodiment of FIG. 2, but has a two-piece design.

In contrast to the first exemplary embodiment of FIG. 2, guide region 38 projects into exit region 39, and transition 40 widens conically in the spray-discharge direction. Furthermore, beginning with the discharge-side end of transition 40, exit region 39 at first runs counter to the discharge direction and then transitions into a cylindrical region, which continues to the discharge-side end 43 of exit region 39.

The present invention is not limited to the exemplary embodiments shown and is also suitable, for instance, for outwardly opening fuel injectors 1 or multi-hole valves.

What is claimed is:

1. A fuel injector for direct injection of fuel into a combustion chamber of an internal combustion engine, comprising:

a valve seat body having a valve-seat surface;

a valve-closure member, which cooperates with the valve-seat surface of the valve-seat body to form a sealing seat; and at least one spray-discharge orifice provided downstream from the sealing seat, which has a guide region and an exit region arranged at a discharge-side end, the exit region widening at least one of i) in a stepped manner by at least one first step, and ii) at least in part continuously, beginning with a transition from the guide region into the exit region;

wherein a fuel jet, which emerges from the guide region at the transition and widens uniformly at a jet angle, passes the discharge-side end of the exit region while maintaining a gap between the fuel jet and an inner wall of the exit region, and, after a distance s, the gap having a dimension that is greater than zero, and wherein a first volume remains in the exit region between the fuel jet and the inner wall of the exit region, and wherein the first volume has a longitudinal cross-sectional area (Ag), and a coefficient (B) characterizing the first volume is calculated according to the following equation:

$$B = \frac{|D \cdot \pi \cdot Ag|}{|d \cdot \pi \cdot s|}$$

D being a first diameter between centers of mass of the longitudinal cross-sectional area Ag, d being a second diameter of the fuel jet at a midpoint of distance s, and the coefficient B being not smaller than 0.5 and not greater than 2.5.

2. The fuel injector as recited in claim 1, wherein the gap dimension is not greater than 0.3 mm and not smaller than 0.1 mm.

3. The fuel injector as recited in claim 1, wherein the guide region and the exit region are arranged coaxially with respect to one another.

4. The fuel injector as recited in claim 1, wherein the transition widens conically in a discharge direction.

5. The fuel injector as recited in claim 1, wherein the exit region is cylindrical.

6. The fuel injector as recited in claim 1, wherein the guide region projects into the exit region.

7. The fuel injector as recited in claim 6, wherein, at a discharge-side end of the transition, the exit region at first widens continuously counter to the discharge direction.

8. The fuel injector as recited in claim 1, wherein the exit region is cylindrical in a region of the discharge-side end.

* * * * *